United States Patent [19]

Turner

[11] Patent Number: 4,890,553

[45] Date of Patent: Jan. 2, 1990

[54] POSITIONING AND ATTACHMENT MEANS FOR FLEXIBLE PRINTING PLATES

[75] Inventor: Michael R. Turner, Tacoma, Wash.

[73] Assignee: Heath Custom Press, Inc., Wash.

[21] Appl. No.: 310,882

[22] Filed: Feb. 16, 1989

[51] Int. Cl.[4] ..... B41F 27/00

[52] U.S. Cl. ..... 101/389.1; 101/DIG. 36

[58] Field of Search ..... 101/389.1, 1, DIG. 36, 101/382.1, 415.1

[56] References Cited

U.S. PATENT DOCUMENTS

| | | | |
|---|---|---|---|
| 1,717,391 | 6/1929 | Lamatsch . | |
| 3,566,788 | 3/1971 | Bulza-Schuenemann | 101/389.1 |
| 3,882,775 | 5/1975 | Lytle et al. | 101/389.1 |
| 3,919,937 | 11/1975 | Kostal | 101/389.1 |
| 4,036,113 | 7/1977 | Kocsis et al. . | |
| 4,143,597 | 3/1979 | Kesten et al. . | |
| 4,223,604 | 9/1980 | Brehm et al. . | |
| 4,505,199 | 3/1985 | Hasegawa et al. | 101/389.1 |
| 4,528,906 | 7/1985 | Hasegawa | 101/389.1 |
| 4,581,993 | 4/1986 | Schoneberger . | |
| 4,688,483 | 8/1987 | Schollenberger . | |
| 4,823,697 | 4/1989 | Randazzo | 101/389.1 |

FOREIGN PATENT DOCUMENTS 0236741 9/1987 European Pat. Off. ..... 101/389.1

*Primary Examiner*—E. H. Eickholt

*Attorney, Agent, or Firm*—Dowrey, Cross & Cole

[57] ABSTRACT

Apparatus and procedure for accurately positioning and magnetically holding a flexible ferrous plate on the surface of a rotary printing cylinder. Movable registering pins and a permanent bar magnet are mounted to the rotary cylinder and controlled by a single operating means. The pins and magnetic bar are alternately moved toward and away from the cylinder surface such that, when the pins are initially projected to register with positioning holes in the plate, the magnet is withdrawn. When the pins are withdrawn the magnet is simultaneously advanced to "grab" the leading edge of the plate. The operating means is controlled by a foot pedal linkage. The trailing edge of the plate is held in position by a second bar magnet. To remove the plate, the procedure is reversed so as to simultaneously advance the register pins and retract the bar magnet to release the leading edge of the plate.

11 Claims, 3 Drawing Sheets

POSITIONING AND ATTACHMENT MEANS FOR FLEXIBLE PRINTING PLATES

BACKGROUND OF THE INVENTION

1. Field of the Invention

The present invention relates to rotary printing cylinders of the type which are fitted with a removable thin flexible impression or printing plate. This type of printing cylinder and printing plate may be used in a wide variety of printing machines and processes common to the industry. More particularly, the present invention relates to a an apparatus and procedure for accurately positioning, securely attaching and selectively releasing the printing plate to the rotary cylinder. The printing plate is initially positively positioned by indexing pins and is secured in operating position on the surface of the cylinder by means of permanent magnets. A novel mechanical linkage alternately advances and retracts the positioning pins and the magnet holding means relative to the cylinder surface to sequentially release and "grab" the printing plate.

2. DESCRIPTION OF THE PRIOR ART

Rotary cylinder printing presses of various types are well-known in the art and provide a continuously rotating impression cylinder for repetitive printing of successive sheets or continuous strip stock. It is common practice to provide a thin flexible impression plate which wraps partially or completely about the printing cylinder and which is readily removable or replaceable. Various means have been devised for releasably holding the flexible printing plate to the cylinder as for instance vacuum, adhesives and mechanical fasteners. Mechanical fasteners such as clamps, wedges or other securing devices have been used to both initially position the plate and to secure it during operation. These approaches are generally cumbersome, complicated and inefficient. Magnetic force has also been utilized to provide the securing or holding force to adhere the flexible printing plate, usually made of thin flexible ferrous material, to the rotary cylinder. The primary problem with utilizing magnetic attraction is the need to initially register or index the flexible plate accurately in the presence of a constant magnetic force. This problem has been alleviated by the use of electromagnetic securing devices located within the cylinder with suitable switching arrangements, the electromagnets may be energized after the flexible ferrous plate has been properly positioned or registered using indexing pins or other mechanical devices. The F. C. Marquardt U.S. Pat. No. 1,531,492 and the J. S. Fleming U.S. Pat. No. 1,939,681 are examples of this type of apparatus. The obvious disadvantage of this approach, of course, is the need for rather complicated switching mechanisms and slip rings and the like for providing electrical current inside the rotating cylinder. Both of these prior art devices are illustrative of the concept of a fixed position magnets and cleats or dogs which initially position the printing plate prior to energization of the electromagnets.

Another common approach is similar to the prior art discussed with the exception that a fixed permanent magnet or magnets are located on the surface or within the rotary cylinder. The permanent magnets tightly hold the thin flexible ferrous plate to the cylinder once it is applied to the surface. In addition, clamp blocks, screw fasteners or indexing pins are utilized to initially position the flexible printing plate and to aid in its adherence to the cylinder. The disadvantage to this approach is the fact that the printing plate can only be removed by prying or forcing it off of the cylinder surface against the constant magnetic force. Examples of this type of device are disclosed in the J. J. Kessler U.S. Pat. No. 2,978,980 and the J. W. Martt U.S. Pat. No. 3,217,645. Here again the magnets are located in fixed position and the aligning pins or other mechanical positioning means are also stationary. The Welch, Jr. U.S. Pat. No. 3,670,646 is illustrative of another approach using magnetic forces wherein magnetic particles are dispersed in the body of the printing plate which is then applied to a ferrous cylinder or other ferrous surface on the cylinder. The Welch, Jr. patent also utilizes the concept of registration pins or dowels for accurately positioning the printing plate on the cylinder. This type of structure also requires that the printing plate be forcibly detached against the attraction of the magnetic particles.

Generally speaking, the use of electromagnetic forces as the securing means is not desirable since the apparatus is expensive, complicated and cumbersome. The operator usually has both hands occupied in manually positioning the cylinder and attempting to initially position the printing plate. His job is only complicated by having to also operate the electromagnetic controls. With the use of permanent magnets, however, it becomes extremely difficult to initially accurately position the plate. The magnetic forces which are strong enough to hold the plate to the rotating cylinder will tend to "grab" the ferrous printing plate the instant it comes into close proximity to the surface of the cylinder.

SUMMARY OF THE INVENTION

The present invention provides an improved apparatus and procedure for accurately positioning and securely adhering a thin flexible ferrous metal printing plate to a rotary printing cylinder with the use of permanent magnetic means and register pins. With the present invention, both the registering pins and the magnetic securing means are movably mounted within the cylinder and are alternately brought into operative position by means of a unique operating mechanism. The operating mechanism is remotely actuated by foot pedal means thus freeing both the operator's hands to perform the plate changing function. According to the present invention, the printing plate may be rapidly and accurately changed in an extremely efficient manner. The indexing pin means is initially projected from the surface of the cylinder while the permanent magnet holding means is withdrawn from the proximity of pole pieces which extend to the cylinder surface. With the magnet withdrawn, the printing plate may be brought into accurate registry with the cylinder. Once the printing plate is properly indexed or positioned, the permanent magnetic is advanced to the proximity of the pole pieces which extend to the cylinder surface in order to "grab" the flexible ferrous printing plate while the pins are simultaneously withdrawn to prevent any interference with the printing operation. The alternate engagement and disengagement of the indexing means and the magnetic holding means is accomplished solely by a foot pedal linkage.

DETAILED DESCRIPTION OF THE PREFERRED EMBODIMENT

Figure 1:
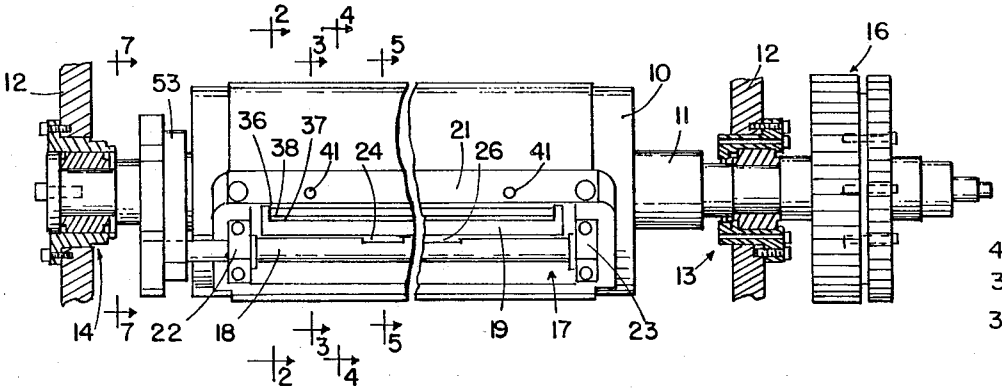
FIG. 1 is a top plan view of the printing cylinder and the plate attachment means.

Referring to FIG. 1, a rotary printing cylinder 10 is carried on a rotatably mounted shaft 11 which is journaled for rotation in the machine frame 12 by means of suitable bearing assemblies 13 and 14 which are well known in the art. The shaft 11 is driven for rotation by means of the drive gears 16 in a conventional manner. The details of the printing press are not essential for the understanding of the present invention and hence are not illustrated in order to simplify the disclosure. Although the details of the cylinder construction may vary, it is usually fabricated from stainless or carbon steel with an extremely smooth surface for the reception of the printing plate.

As seen in FIGS. 2–5, the cylinder 10 is generally hollow with a segment of the periphery thereof open for the reception of the magnetic securing means and positioning pin assembly indicated generally at 17. The magnetic bar and pin assembly includes an axially extending operating rod 18, a magnetic bar assembly 19 and a pin mounting bar insert 21. As illustrated in FIGS. 2–5, the entire assembly 17 is located within the periphery of the hollow cylinder 10 and is mounted to the cylinder for rotation therewith.

Figure 3A:
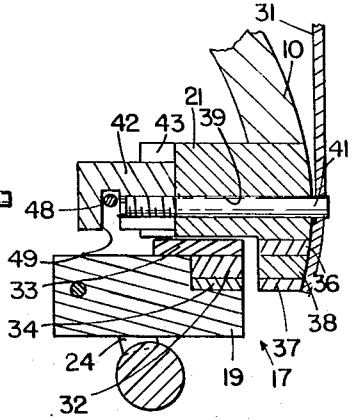
FIG. 3A is a view similar to FIG. 3 showing the registering pins projected and the magnet retracted.
Figure 4:
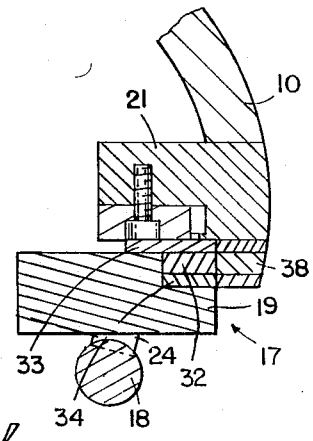
FIG. 4 is a cross-sectional detail taken along lines 4—4 of FIG. 1.

As may be seen most clearly in FIG. 1, the operating shaft 18 extends coaxially with the cylinder 10 and is mounted within the body of the cylinder by means of the journal blocks 22 and 23 carried by the body of the cylinder. As will be presently described in detail, rotation of the shaft 18 in the counterclockwise direction results in withdrawing the permanent magnet bar assembly 19 from the proximity of pole pieces presently to be described which extend to the cylinder surface. Simultaneously the indexing pins are extended through the pin mounting bar assembly 21 to allow initial positioning of the printing plate as illustrated in FIG. 3A. Reverse rotation of the operating shaft 18 in the clockwise direction serves to withdraw the pins while simultaneously advancing the magnetic bar assembly to "grab" the printing plate in its registered position.

Figure 3:
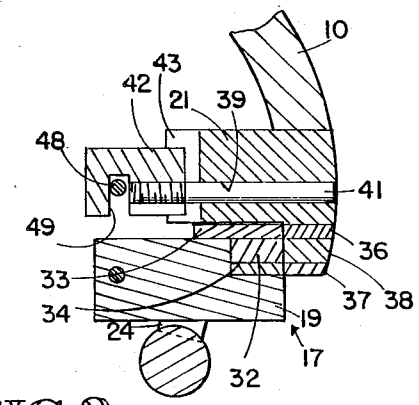
FIG. 3 is a cross-sectional detail taken along lines 3—3 of FIG. 1.
Figure 2:
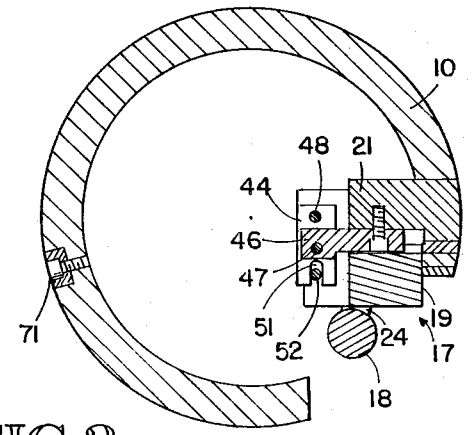
FIG. 2 is a cross-sectional view taken along lines 2—2 of FIG. 1.
Figure 5:
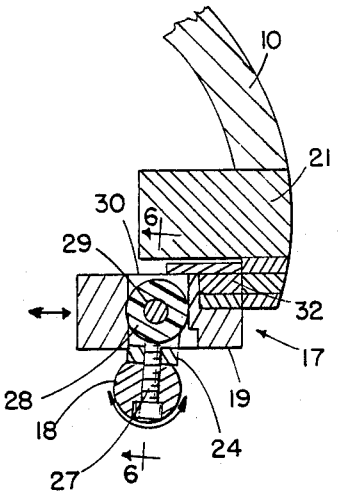
FIG. 5 is a cross-sectional detail taken along lines 5—5 of FIG. 1.
Figure 6:
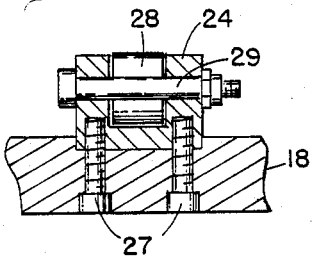
FIG. 6 is a cross-sectional detail taken along 6—6 of FIG. 5.

Referring to FIG. 1, the magnetic bar assembly 19 extends closely adjacent and parallel to the shaft 18 and comprises a rectangular bar member which is engaged and supported by the two roller blocks 24 and 26 carried by the shaft 18. The roller blocks may be identical and are longitudinally spaced near the center portion of the shaft 18. The roller block 24 is shown in detail in FIGS. 5 and 6. Each of the blocks 24 and 26 is attached to the shaft 18 by means of the bolts 27 and is generally U-shaped in configuration as viewed in FIG. 6. Each block 24 and 26 mounts a roller 28 on a suitable cross-axle 29. In order to support and retain the magnetic bar assembly 19, the bar is provided with rectangular or slotted openings 30 for reception of the roller block assembly. As seen in FIG. 5, rotation of the shaft 18 moves the magnetic bar assembly either toward or away from the surface of the cylinder 10 by action of the roller 28 within the slotted opening 30. Movement of the bar 19 is limited in the right hand direction as viewed in FIGS. 2–5 by means of the pin mounting bar assembly 21. One or more bar magnets 32 comprising a permanent magnet assembly are mounted in rectangular slots in the forward edge of bar assembly 19. Each bar magnet 32 is provided with upper and lower pole pieces 33 and 34 respectively which may be affixed to the slotted bar 19 by means of non-magnetic screws or the like (not shown). The edge of the longitudinal opening in the cylinder 10 is likewise equipped with upper and lower ferrous metal pole pieces 36 and 37 which may also be held in place by screws or any other suitable fastening means (not shown). The pole pieces 36 and 37 are separated by a non-magnetic stainless steel spacer 38 as is conventional in the art. With the pole pieces 36 and 37 registering with the pole pieces 33 and 34 when the bar magnet is in the engaged position as shown in FIG. 3 the register pins are withdrawn and a printing plate may be held securely to the surface of cylinder 10.

The pin mounting bar 21 has bores 39 for receiving the register pins 41, two of which are shown in FIG. 1. The outside facing of the pin mounting bar assembly 21 as well as the pole pieces 36 and 37 and the spacer 38 will of course be machined so as to conform to the curvature of the printing cylinder. Referring to FIG. 3, each register pin is screw threaded into a pin block 42 located in suitable notches 43 in the back side of the bar 21. The pin blocks 42 and pins 39 are mounted for reciprocating motion within the notches 43 as will be presently explained. As shown in the cross-section of FIG. 2, each pin block assembly is provided with an operating lever 44 which is pivotally mounted on the hanger bar 46 bolted to the underside of the bar 21 in a suitable notched opening. The levers 44 are mounted for pivotal movement on cross pins 47 carried by the hangers 46. Each lever 44 is provided with a cross pin 48 fixed thereto which engages a suitable slot 49 in the associated pin block. The lower end of the lever 44 is slotted as at 51 to receive a cross pin 52 mounted in a slotted portion on the back side of the magnetic bar assembly 19. With this arrangement, it will be seen that rotation of the operating shaft 18 in the counterclockwise direction will serve to move the magnetic bar assembly 19 away from the pole pieces 36 and 37 and to simultaneously advance the registering pins to project beyond the surface of the cylinder by means of the lever and pin mechanism 44, 48, 52. This relationship is shown best in FIG. 3A. Conversely, clockwise rotation of the operating shaft 18 advances the magnetic bar assembly 19 toward the pole piece and withdraws the registering pins 39. It is this basic sequence of movements which permits the ferrous metal printing plate to be initially accurately positioned using the pin alignment as shown in FIG. 3A without interference from the magnetic attraction. As the pins are retracted, the printing plate 31 is "grabbed" by the permanent bar magnet 32.

Figure 7:
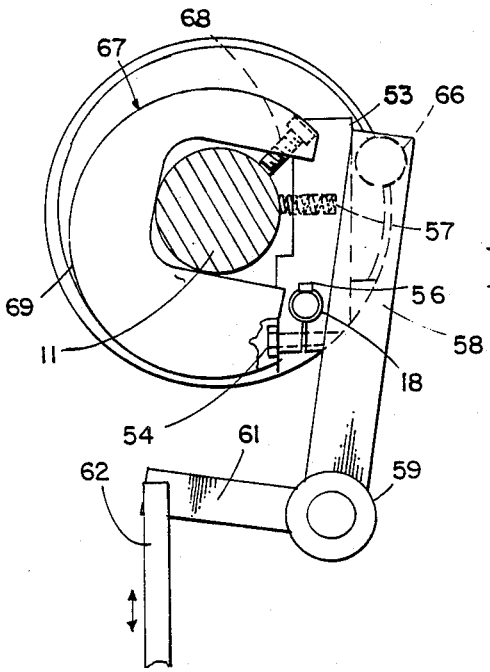
FIG. 7 is a cross-sectional view taken along lines 7—7 of FIG. 1 showing the plate release mechanism.
Figure 8:
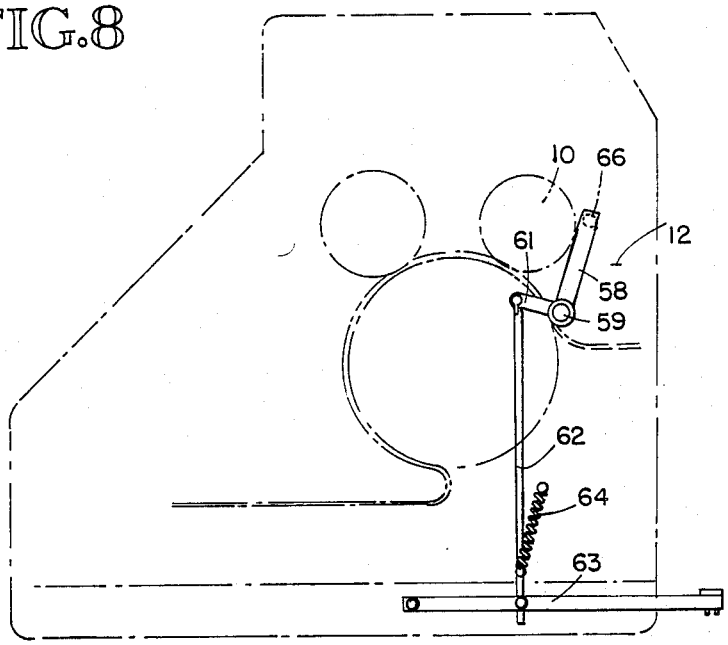
FIG. 8 is an elevational view showing the foot pedal plate release operating mechanism and its mounting position relative to the press and printing cylinder, shown in phantom.

FIGS. 7 and 8 illustrate the mechanism for remotely controlling the rotation of the operating shaft 18. As shown in FIGS. 1 and 7, the operating shaft 18 is provided with a radially extending arm 53. The arm 53 may be fixed to the end of shaft 18 by means of the clamping screw 54 and a suitable key 56. Thus, swinging of the arm 53 results in rotation of the operating shaft 18 for alternately engaging and disengaging the registering pins and the magnetic bar. As viewed in FIG. 7, the arm 53 is biased to rotate the shaft 18 in the clockwise direction by means of a compression spring 57 located in a suitable bore in the arm and seated against the cylinder shaft 11. This spring bias holds the magnetic bar assembly 19 in its extreme engaged position against the pole prices of the pin mounting bar assembly 21 as viewed in FIGS. 2–5.

Means for moving the arm 53 in the counterclockwise direction comprises the foot pedal operated release arm 58 carried by the stub shaft 59 rotatably mounted to the press frame in any suitable manner (not shown). The shaft 59 is also provided with a crank arm 61 connected to a vertical pull rod 62. The pull rod 62 is pivotally connected to the foot pedal 63 which is pivotally mounted at one end to the base of the press frame as shown in FIG. 8. The pull rod 62 is spring biased in the upward direction by the tension spring 64 so as to normally hold the release arm 58 in the unactivated position out of contact with the arm 53. The release arm 58 includes a roller 66 on its distal end for making actual rolling contact with the arm 53 as it is swung thereagainst.

As seen most clearly in FIG. 7, the arm 58 and the roller 66 are positioned such that the roller is aligned with the arm 53 and the arm 58 is aligned with a stop plate 67 fixed on the cylinder shaft 11. The stop plate 67 is C shaped so as to engage about the shaft 11 and is held in adjusted position by means of the set screw 68. The plate 67 functions to prevent the roller 66 of the arm 57 from contacting the arm 53 until such time as the printing cylinder is in the desired position of rotation for access in order to remove the printing plate. The cam surface 69 on the plate stop contacts the arm 58 for this purpose. This position of rotation of the cylinder will depend on the optimum location for access to the cylinder by the operator.

In order to change the printing plate according to the present invention, the press will be turned off in preparation for the change. Under these conditions, the printing plate 31 is being securely held to the cylinder surface at is leading edge, in terms of direction of rotation of the cylinder, by the magnetic pole prices 36 and 38 with the permanent bar magnetic 32 in the position shown in FIG. 3. The trailing edge of the plate 31 is held to the cylinder by the fixed permanent magnetic bar 71. The cylinder is first rotated to the access position. The operator then depresses the foot pedal 63 to bring the release arm 58 and its roller to come into contact with the release arm 53 to rotate the shaft 18. Since rotation of the shaft 18 is in the counterclockwise direction, the bar magnet 32 is moved away from the pole pieces 36 and 37, reducing the magnetic force at the surface of the cylinder and the end of the printing plate 31 is released. The register pins 41 are simultaneously moved to their extended position shown in FIG. 3A. The leading edge of the plate may then be lifted off the surface of the cylinder as it is further rotated with the trailing end of the printing plate being finally lifted from the magnetic bar 71.

To attach a new printing plate, the procedure is essentially reversed. With the foot pedal 63 depressed, the magnetic bar is released as previously described. Since the pins 41 are projecting beyond the surface of the cylinder, the printing plate with matching holes in its leading edge is accurately positioned on the surface of the cylinder. The foot pedal is then released causing the pins 41 to retract and the magnetic bar moves forward to "grab" the printing plate. The printing plate which has a pre-curvature on its end portions is then easily laid down on the cylinder as the cylinder is rotated in the forward direction. The trailing edge of the plate is finally laid down on the magnetic bar 71 and the plate is securely and accurately applied to the cylinder surface and ready for printing.

Although the present invention has been described and illustrated with respect to a specific embodiment thereof, it will be apparent to those skilled in the art that modifications to the stuctures described may be made without departing from the spirit of the invention or from the scope of the appended claims.

What is claimed is:

1. Apparatus for positioning and securing a flexible plate to the surface of a cylinder comprising in combination:

plate holding means mounted by said cylinder for movement between extended and retracted positions respectively toward and away from the surface thereof, plate register means mounted by said cylinder for movement between extended and retracted positions respectively toward and away from the surface thereof, and bidirectional operating means connected to said plate holding means and said plate register means to simultaneously move said holding means and said register means alternately in opposite directions toward and away from the cylinder surface respectively, whereby said plate register means and said plate holding means may be simultaneously operated alternately in both directions to sequentially position, hold and release said plate.

2. The combination according to claim 1 wherein:

said printing plate comprises a thin flexible ferrous metal plate having register openings adapted to cooperate with said plate register means in the extended position thereof, and said plate holding means includes permanent magnet means for holding said plate against the cylinder surface in the extended position thereof.

3. The combination according to claim 1 including:

mounting means carried by said cylinder for mounting said plate holding means and said plate register means for simultaneous reciprocal movement in opposite directions toward and away from the cylinder surface respectively;

said bidirectional operating means being connected to said mounting means and spring biased in a first direction to retract said plate register means and to extend said plate holding means toward said cylinder surface to hold the plate thereon during printing, and foot pedal operated linkage mounted remote from said cylinder to selectively contact and move said operating means against said spring bias so as to retract said magnet to release said plate and to simultaneously extend said register means.

4. The combination according to claim 3 wherein;

said printing plate comprises a thin flexible ferrous metal plate having register openings adapted to cooperate with said plate register means in the extended position thereof, and said plate holding means includes permanent magnet means for holding said plate against the cylinder surface in the extended position thereof.

5. Apparatus for positioning and securing a flexible ferrous printing plate to the surface of a printing cylinder comprising in combination;

permanent magnet means mounted by said cylinder for movement between extended and retracted positions respectively toward and away from the surface of said cylinder, register pin means mounted by said cylinder for movement between extended and retracted positions respectively toward and away from the surface of said cylinder, bidirectional operating means connected to said magnet means and said register pin means to simultaneously move said magnet means and said register pin means alternately in opposite directions, whereby said magnet means may be retracted and said pin means simultaneously extended to position said plate and said magnet means then extended and said register pins means simultaneously retracted to hold said plate to said cylinder for printing.

6. In combination with a rotary printing cylinder having at least a portion of the surface thereof adapted to receive a flexible ferrous printing plate to be held in position on the cylinder surface, a printing plate attachment means comprising;

permanent magnet means for holding the plate to the surface of said cylinder;

mounting means carried by said cylinder for mounting said magnet means for movement between extended and retracted positions respectively toward and away from the surface of the cylinder, register pin means for engaging suitable holes in said plate in initially position the plate on the surface of the cylinder, pin mounting means carried by said cylinder for mounting said pins for movement between extended and retracted positions respectively toward and away from the surface of said cylinder, and bidirectional operating means connected to said magnet and pin mounting means respectively to simultaneously move said magnet means and said register pin means alternately in opposite directions, whereby said operating means may be operated in one direction to extend said register pins to the surface of said cylinder to initially position a printing plate on the surface thereof while simultaneously retracting said magnet means and operated in the opposite direction to retract said pins to permit said magnet means to extend and adhere said plate to the cylinder surface.

7. The combination of claim 6 wherein;

said register pin mounting means includes a pin mounting assembly for supporting said pin means for reciprocating movement between a first extended position protruding beyond the surface of said cylinder to engage a printing plate and a second retracted position within the wall of the cylinder, and said magnet mounting means mounts said magnet means for reciprocating movement between a first extended position in close proximity to the cylinder wall for adhering said ferrous plate and a second retracted position spaced from said cylinder wall to release said plate.

8. The combination of claim 7 wherein said bidirectional operating means comprises;

an elongated rotary shaft extending coaxially with said cylinder and journaled for rotation therein, said rotary shaft including connector means for contacting said magnet mounting means to move the magnet between said first and second positions upon rotation of said shaft, and reversing lever means connected between said magnet mounting means and said pin mounting means to reciprocate said pin means in the opposite direction from said magnet means.

9. The combination according to claim 6 including;

spring biasing means for biasing said operating means in the direction to extend said magnet means to normally hold said plate on the cylinder surface, and release linkage means mounted adjacent said cylinder for selectively contacting and actuating said operating means in a direction against the bias of said biasing means to retract said magnet means and release said plate.

10. The combination of claim 8 including;

crank arm means connected to rotate said rotary shaft, and spring biasing means for biasing said crank arm in the direction to extend said magnet means to normally hold said plate on the cylinder surface, and release linkage means mounted adjacent said cylinder for selectively contacting and actuating said work arm in a direction against the bias of said spring biasing means to retract said magnet means and release said plate.

11. The combination according to claim 10 wherein said release linkage means includes foot pedal control means remote from said cylinder for controlling said release linkage.

* * * * *